US006065979A

United States Patent [19]

Lai et al.

[11] Patent Number: 6,065,979

[45] Date of Patent: May 23, 2000

[54] ELECTRICAL CONNECTOR MANUFACTURING METHOD

[75] Inventors: Chin-Yi Lai; Kun-Tsan Wu, both of Tu-Chen; Chaur-Shiun Chen, Chia-I, all of Taiwan

[73] Assignee: Hon Hai Precision Ind. Co., Ltd., Taipei Hsien, Taiwan

[21] Appl. No.: 09/196,634

[22] Filed: Nov. 19, 1998

[30] Foreign Application Priority Data

Nov. 19, 1997 [TW] Taiwan ..... 86117415

[51] Int. Cl.[7] ..... H01R 9/09

[52] U.S. Cl. ..... 439/79; 439/608

[58] Field of Search ..... 439/79, 80, 607, 439/608, 108; 29/837

[56] References Cited

U.S. PATENT DOCUMENTS 5,066,240 11/1991 Verdun ..... 439/607
5,125,853 6/1992 Hashiguchi ..... 439/607
5,643,010 7/1997 Wu ..... 439/79
5,688,130 11/1997 Huang ..... 439/79
5,931,687 8/1999 McFarlane et al. ..... 439/79

*Primary Examiner*—Neil Abrams
*Assistant Examiner*—Son V. Nguyen
*Attorney, Agent, or Firm*—Wei Te Chung

[57] ABSTRACT

A method for manufacturing an electrical connector includes the following steps. (a) Forming a number of insert plates and integrally fixing a plurality of conductive pins to the insert plates so as to form the same number of unitary components., (b) Inserting mounting sections of the pins into corresponding holes defined in a spacer component by component. (c) Fitting the insert plates into a slot defined in an insulator. (d) Mounting a shielding shell to the insulator to shield the conductive pins. The method may further include a step of bending the mounting sections of the pins an angle of 90 degrees before the mounting sections are fit into the holes on the spacer and a step of securing the shielding shell to the insulator by means of fasteners.

15 Claims, 11 Drawing Sheets

ELECTRICAL CONNECTOR MANUFACTURING METHOD

FIELD OF THE INVENTION

The present invention relates generally to an electrical connector manufacturing method, and in particular to a method for manufacturing a high density connector whereby the conductive pins thereof are efficiently and effectively fit into and retained by a spacer.

BACKGROUND OF THE INVENTION

Electrical connectors mounted to and in electrical connection with a circuit board may sometimes require exposed portions of the pins to be bent or deformed before being fixed to the circuit board by soldering. However, for a high density connector that has a great number of pins arranged in limited space, the pitch of the pins, that is the distance between two adjacent pins, is quite small. To avoid undesired contact between the pins, a spacer is usually provided and incorporated with the high density connector for positioning and retaining the pins. Examples of spacers are disclosed in Taiwan patent application Nos. 81210871 and 84207642 and U.S. Pat. No. 5,125,853.

In FIG. 1 of the attached drawings, an example of a conventional high density connector is shown. The connector comprises an insulator 10 defining a slot for receiving a plurality of conductive pins 11 therein. Each pin 11 has a portion extending out of the insulator 10 and bent 90 degrees for fitting into positioning holes 131 defined on a spacer 13. A shielding shell 12 is attached to the insulator 10 by means of fasteners 14 and clips 15 for shielding the pins 11.

As shown in FIG. 2, the manufacturing process of the conventional high density connector comprises the following steps. The pins 11 are fit in the insulator 10 row by row by means of an external jig (step 50). The pins 11 are then bent 90 degrees (step 51) and aligned with and inserted into the corresponding positioning holes 131 of the spacer 13 (step 52). Thereafter, the shielding shell 12 is mounted to the insulator 10 (step 53) and secured thereto by means of the fasteners 14 and the clips 15 (step 54). However, due to the large number of pins 11 is great, inserting the pins 11 in the corresponding positioning holes 131 of the spacer 13 is difficult. A flawed product may be obtained if any one of the pins 11 is not in perfect alignment with the positioning holes 131. Such a manufacturing procedure is laborious and hinders efficient productivity.

Hence, an improved method for manufacturing a high density connector is requisite whereby the pins can be efficiently and effectively fit into the spacer thereby overcoming the disadvantage of the prior art.

SUMMARY OF THE INVENTION

Accordingly, an object of the present invention is to provide a method for manufacturing an electrical connector wherein the conductive pins are separated into groups which are integrated with carrier members whereby the groups of conductive pins are separately mounted to the spacer, thereby reducing the number of pins to be aligned with and inserted therein.

To achieves the above objects, a method for manufacturing an electrical connector in accordance with the present invention comprising the following steps. (a) Forming a number of insert plates and integrally fixing a plurality of conductive pins to the insert plates thereby forming the same number of unitary components. (b) Fitting mounting sections of the pins into corresponding holes defined in a spacer component by component. (c) Fitting the insert plates into a slot defined in an insulator. (d) Mounting a shielding shell to the insulator to shield the conductive pins. The method may further comprise a step of bending the mounting sections of the pins at a of 90 degree angle before the mounting sections are fit into the holes of the spacer and a step of securing the shielding shell to the insulator by means of fasteners.

BRIEF DESCRIPTION OF THE DRAWINGS

The present invention will become apparent to those skilled in the art by reading the following description of a preferred embodiment thereof, with reference to the accompanying drawings, in which.

DETAILED DESCRIPTION OF THE PREFERRED EMBODIMENTS

Figure 4:
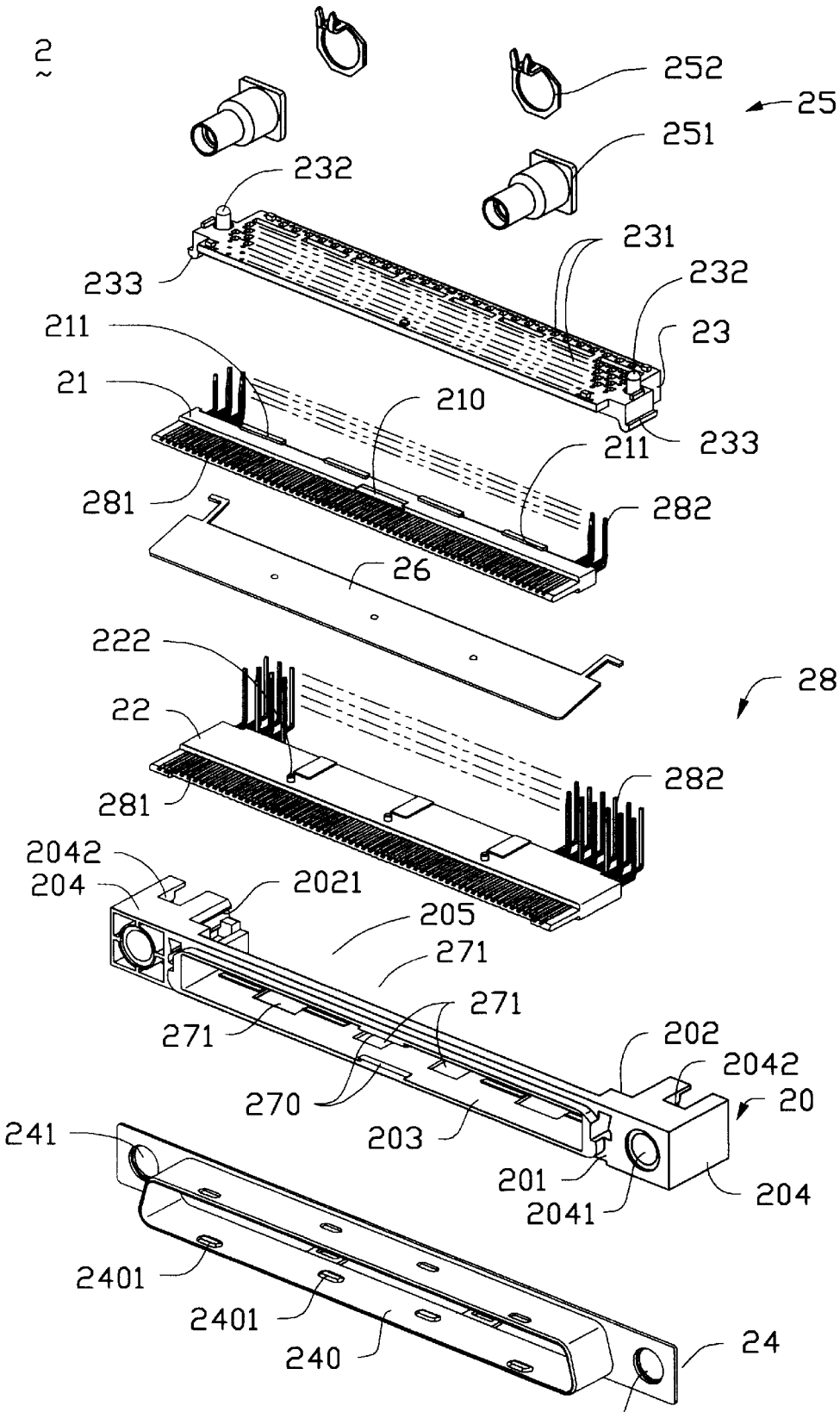
FIG. 4 is an exploded view of the connector in accordance with the present invention.

Referring to the drawings and in particular to FIG. 4, wherein an electrical connector constructed in accordance with the present invention, generally designated by reference numeral 2, is shown, the connector 2 comprises an insulator 20 having an elongated body made of dielectric material and forming a first side face 201 for engaging a mating connector (not shown) and a second side face 202 opposite the first side face 201. A slot 203 is defined in the insulator 20 between the first and second side faces 201, 202 for receiving a first insert plate 21 and a second insert plate 22 therein.

The insulator 20 integrally forms a mounting block 204 on each distal end thereof. The two mounting blocks 204 and the second side face 202 define a space 205 therebetween for accommodating a spacer 23. Each mounting block 204 defines a bore 2041 between the first side face 201 and the second side face 202 for receiving a fastener 251 and a notch 2042 in the second side face 202 for receiving an anchoring ring 252 having two spaced and elastically deformable legs (not labeled). The fastener 251 and the anchoring ring 252 together constitute securing means 25 of the insulator 20.

Figure 5:
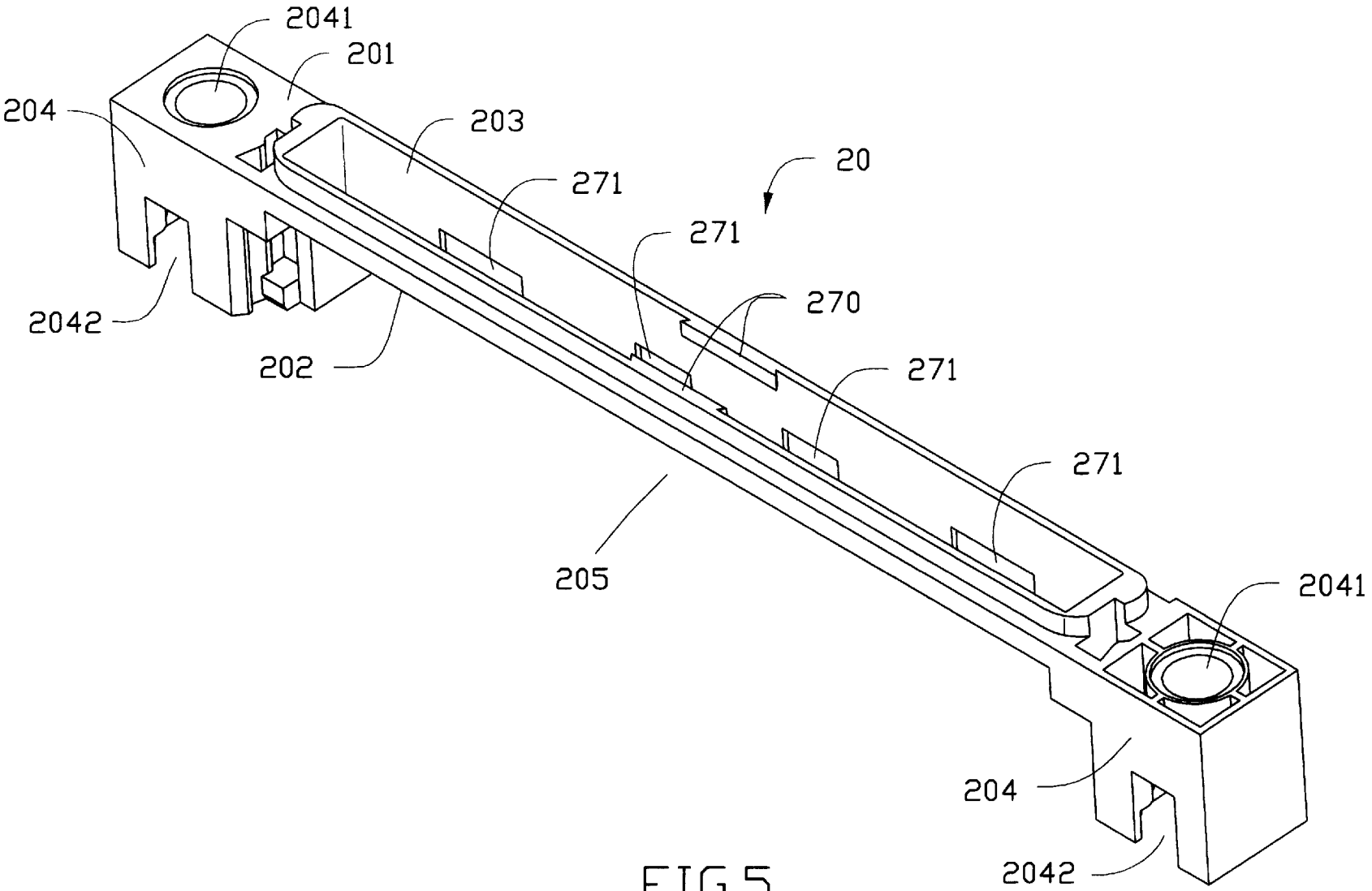
FIG. 5 is a perspective view of an insulator of the connector of the present invention.
Figure 7:
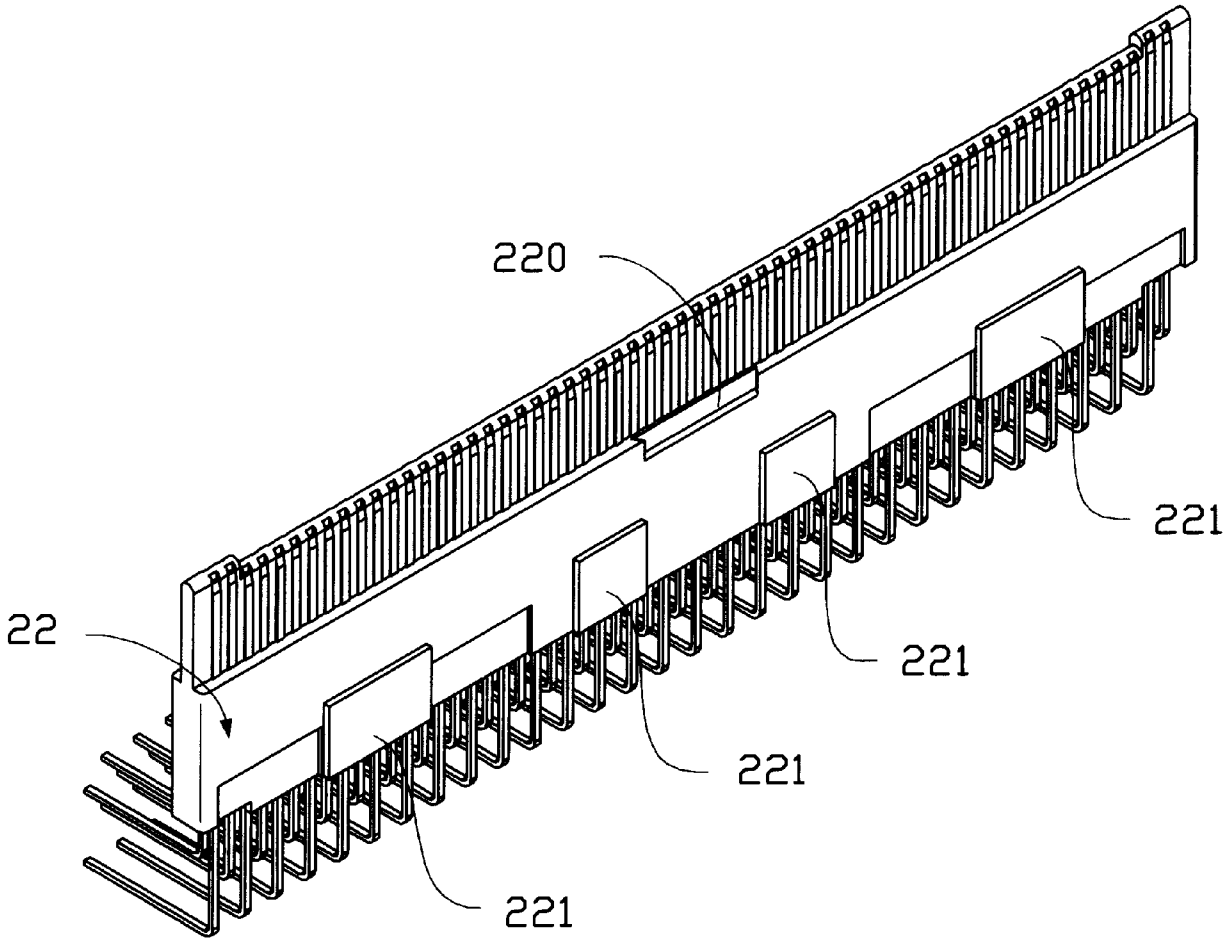
FIG. 7 is a perspective view of a second insert plate of the connector of the present invention.
Figure 8:
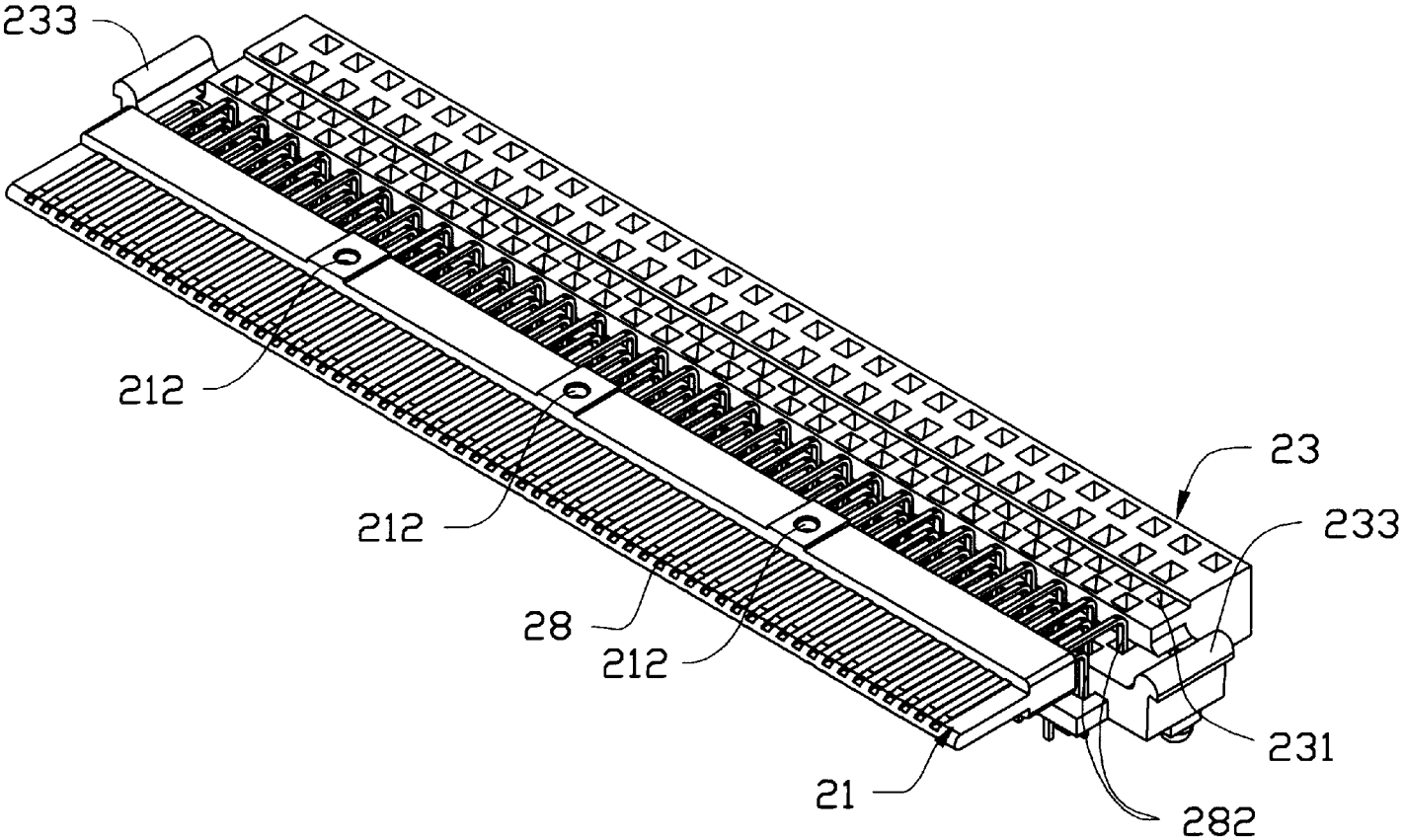
FIG. 8 is a perspective view of the first insert plate mounted to a spacer

Also referring to FIG. 5, the insulator 20 comprises first retention means for retaining the insert plates 21, 22 in the slot 203. The first retention means comprises at least a pair of dovetailed projections 270 formed on opposite inner surfaces of the slot 203 proximate the first side face 201 of the insulator 20. Each dovetailed projection 270 engages with a corresponding complementary notch 210, 220 (FIGS. 4 and 7) respectively defined in the insert plate 21, 22 for preventing the insert plates 21, 22 from being driven toward the first side face 201 during disengagement of the mating connector with the connector 2 of the present invention. The inner surfaces of the slot 203 define a plurality of positioning recesses 271 proximate the second side face 202 for receiving corresponding complementary projections 211, 221 (FIGS. 4 and 7) respectively formed on the insert plates 21, 22 thereby preventing the insert plates 21, 22 from disengaging from the insulator 20 through first side face 201 thereof. In the embodiment illustrated, the projections 211, 221 and the corresponding recesses 271 have rectangular configurations. The positioning recesses 271 cooperate with the dovetailed projections 270 to secure the insert plates 21, 22 in position within the slot 203. In the embodiment illustrated, each of the inner surfaces of the slot 203 forms one dovetailed projection 270 and four positioning recesses 271 as shown in FIGS. 4 and 7.

A plurality of conductive pins 28 are integrally formed in the insert plates 21, 22 in a spaced manner, preferably equally spaced. Each of the insert plates 21, 22 defines grooves (not labeled) on opposite sides thereof for receiving the pins 28 therein. Thus, each of the insert plates 21, 22 has two rows of pins 28, whereby a total of four rows of pins 28 are provided on the insert plates 21, 22.

Each of the pins 28 has an engaging section 281 and a mounting section 282. The engaging section 281 is received in the corresponding groove of the insert plates 21, 22 and located in the slot 203 while the mounting section 282 extends beyond the second side face 202 of the insulator 20 for being surface mounted to a circuit board (not shown).

Figure 6:
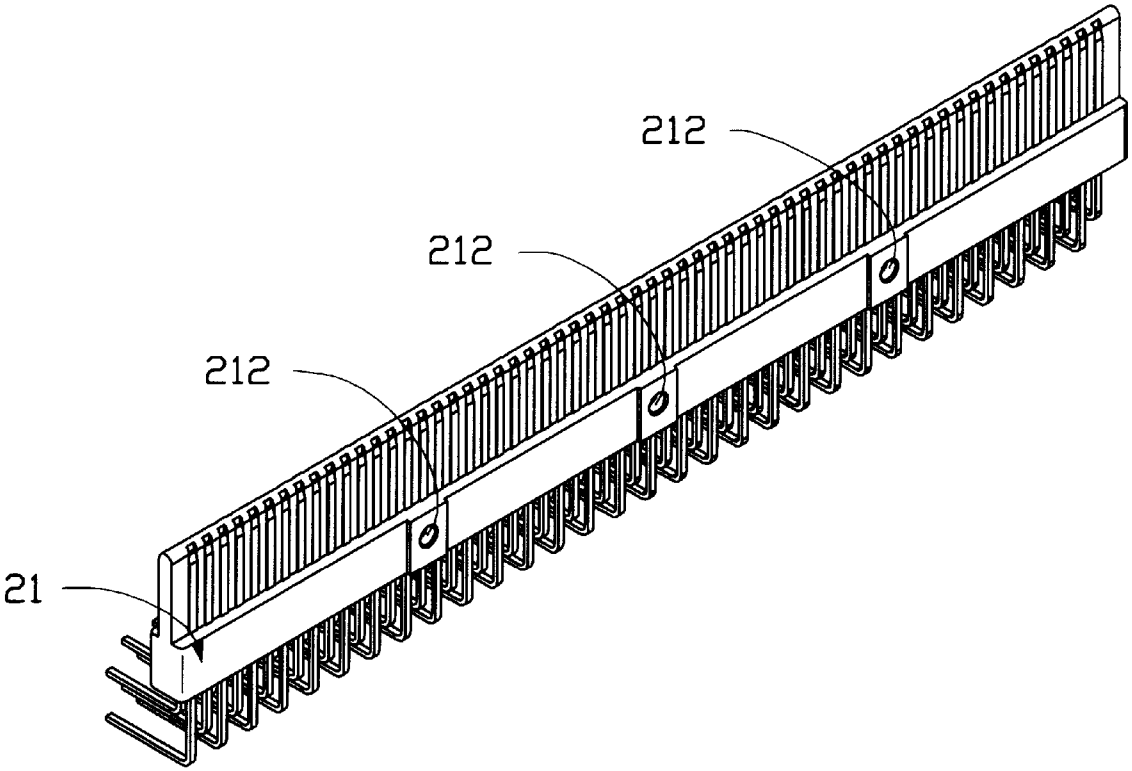
FIG. 6 is a perspective view of a first insert plate of the connector of the present invention.

Simultaneously referring to FIGS. 4 and 6, the first insert plate 21 defines a plurality of positioning holes 212 in surface thereof opposite the surface forming the positioning projections 211 and the notch 210. Bosses 222 provided on the second insert plate 22 are received in the holes 212, thereby engaging the insert plates 21, 22 together. In the embodiment illustrated, three holes 212 are defined in the first insert plate 21.

Also referring to FIG. 7, the notch 220 and the positioning projections 221 are formed on a surface of the second insert plate 22 that faces away from the first insert plate 21 and the bosses 222 (FIG. 4) are formed on an opposite surface thereof. Thus, the notches 210, 220 and the positioning projections 211, 221 of the insert plates 21, 22 are located on surfaces of the insert plates 21, 22 facing away from each other thereby confronting the corresponding inner surfaces of the slot 203 of the insulator 20 and respectively engaging with the dovetailed projections 270 and positioning recesses 271.

A grounding plate 26 defining through holes therein is interposed between the insert plates 21, 22 whereby the bosses 222 of the second insert plate 22 extend through the through holes of the grounding plate 26 for reception in the positioning holes 212 of the first insert plate 21.

The spacer 23 provided in the space 205 comprises a plate-like member received in the space 205 and defining a plurality of holes 231 therein for retaining the mounting sections 282 of the pins 28. The spacer 23 forms two positioning pins 232 for positioning the connector 2 on a circuit board. The spacer 23 also forms barbs 233 for engaging with corresponding shoulders 2021 formed on the mounting blocks 204 proximate the second side face 202 of the insulator 20 thereby fixing the spacer 23 to the insulator 20.

A shielding shell 24 is fixed to the first side face 201 of the insulator 20. The shell 24 forms a D-shaped bracket 240 for enclosing a raised section (not labeled) of the insulator 20 on the first side face 201 whereby the slot 203 is defined through the raised section. A plurality of projections 2401 are formed on the bracket 240 of the shell 24 for providing interferential engagement with the raised section of the insulator 20 thereby fixing the shell 24 thereto. The shielding shell 24 also forms two end extensions (not labeled) each defining a bore 241 therethrough for receiving the fastener 251 which is also received in the bore 2041 of each of the mounting blocks 204 of the insulator 20 thereby securing the shielding shell 24 thereto.

FIGS. 8–11 show the different steps of assembling the connector 2. The pins 28 are mounted in the first insert plate 21 and the mounting sections 282 of the pins 28 are inserted into the corresponding holes 231 of the spacer 23 (see FIG. 8).

Figure 9:
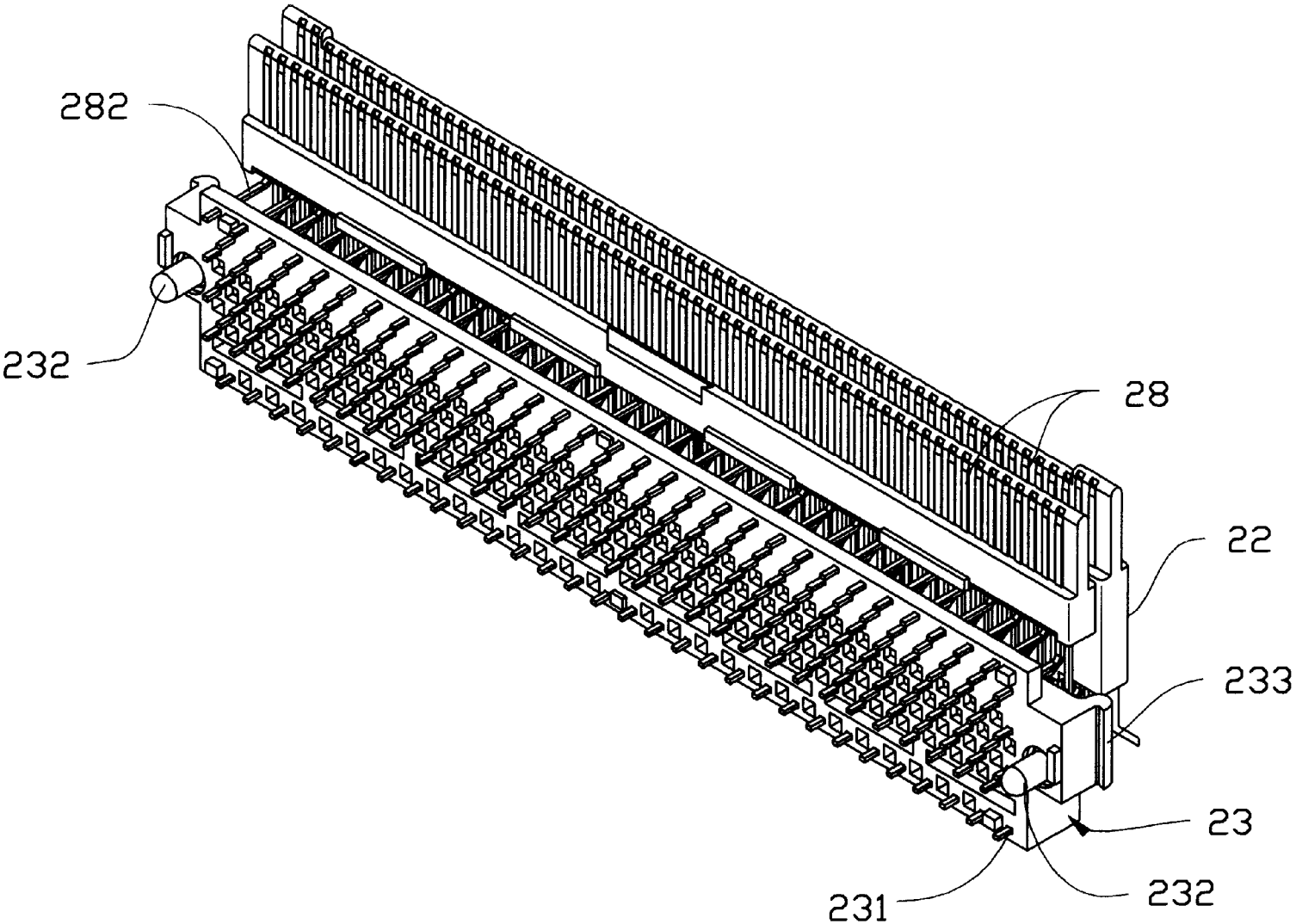
FIG. 9 is a perspective view of the first and second insert plates mounted to the spacer.

The second insert plate 22 is then mounted to the first insert plate 21 by inserting the bosses 222 of the second insert plate 22 into the positioning holes 212 of the first insert plate 21 whereby the grounding plate 26 is interposed therebetween and the mounting sections 282 of the pins 28 on the second insert plate 22 are received in the corresponding holes 231 of the spacer 23 (FIG. 9). The pins 28 are integrally positioned with the insert plates 21, 22 and may thus be mounted into the holes 231 of the spacer 23 in two separate "batches". Therefore, the spacing between the pins 28 may be maintained and proper alignment of the pins 28 with respect to the holes 231 of the spacer 23 may be easily achieved.

Figure 10:
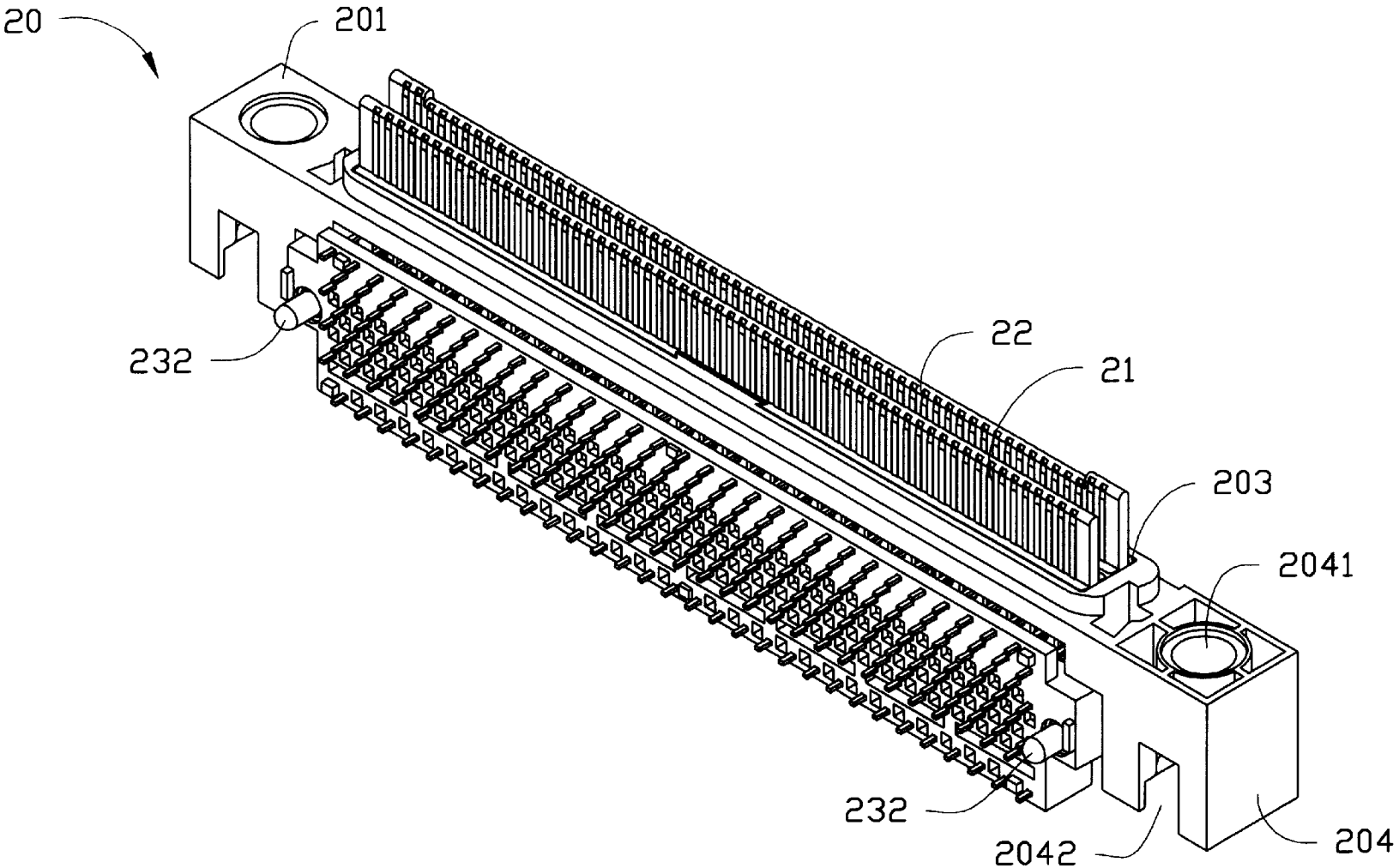
FIG. 10 is a perspective view of the sub-assembly of FIG. 9 mounted to the insulator.

The sub-assembly comprising the insert plates 21, 22 and the spacer 23 is then mounted to the insulator 20 by inserting the insert plates 21, 22 into the slot 203 whereby the notches 210, 220 and the positioning projections 211, 221 of the insert plates 21, 22 engaging with the corresponding dovetailed projections 270 and positioning recesses 271. The barbs 233 of the spacer 23 engage with the corresponding shoulders 2021 of the insulator 20 to securely fix the sub-assembly thereto (FIG. 10). The insert plates 21, 22 are dimensioned to have a portion thereof extending beyond the first side face 201 of the insulator 20.

Figure 11:
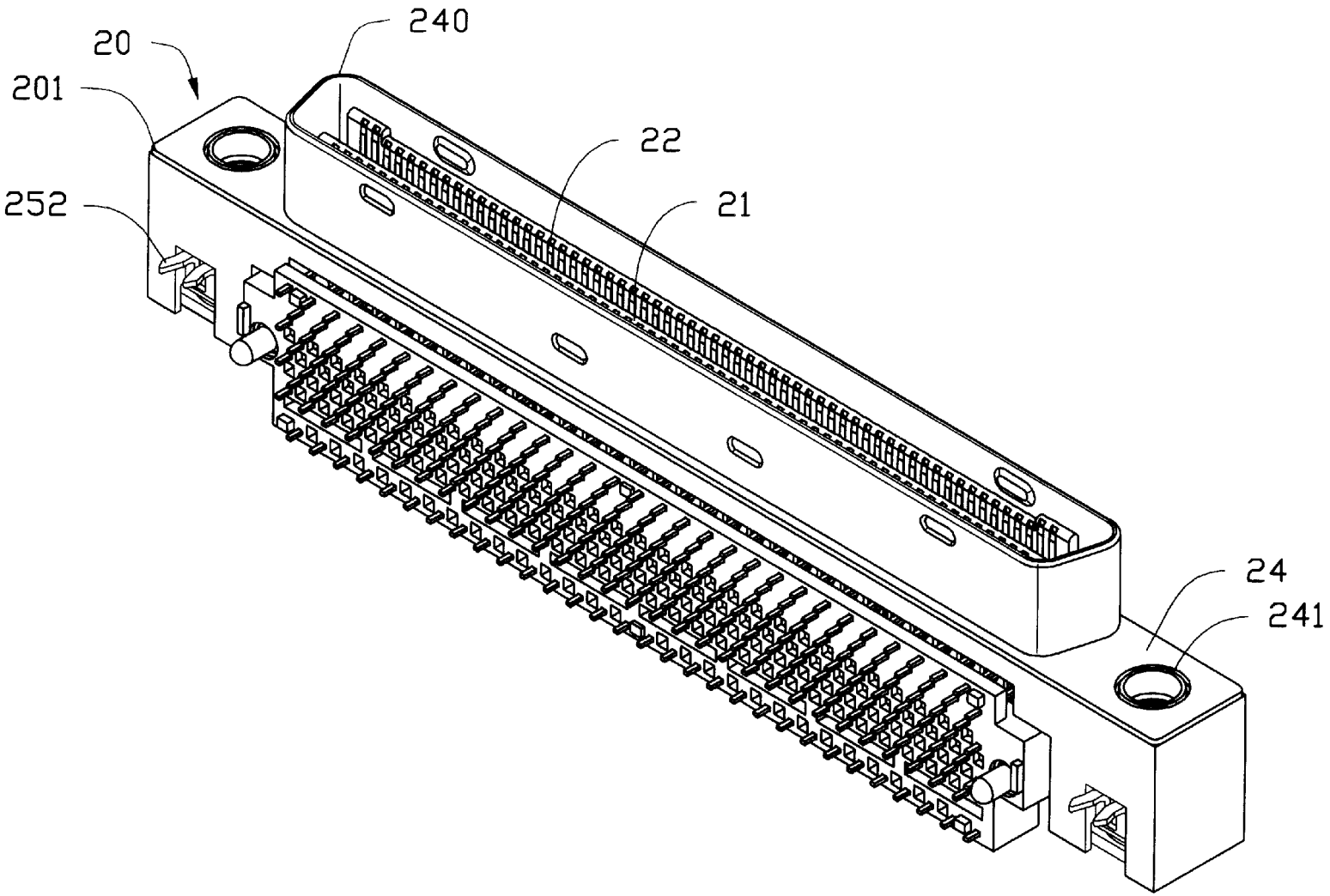
FIG. 11 is an assembled view of FIG. 4.

Thereafter, the shielding shell 24 is positioned over the raised section of the insulator 20 for mounting to the first side face 201 of the insulator 20 thereby shielding the portions of the insert plates 21, 22 extending beyond the insulator 20 (FIG. 11). The shell 24 is then secured to the insulator 20 by inserting the fasteners 251 through the bores 241 of the shell 24 and the bores 2041 of the mounting blocks 204.

The above description clearly discloses that the pins 28 are integrated with the insert plates 21, 22 thereby forming modularized components for secure reception in the insulator 20 with the first retention means comprised of the dovetailed projections 270 and the positioning recesses 271 formed on inner surfaces of the slot 203 of the insulator 20. The dovetailed projections 270 (cooperating with the notches 210, 220 of the insert plates 21, 22) and the positioning recesses 271 (cooperating with the positioning projections 211, 221 of the insert plates 21, 22) secure the insert plates 21, 22 to the insulator 20, whereby the pins 28 are securely mounted therein during engagement/disengagement between the connector 2 and the mating connector.

Figure 1:
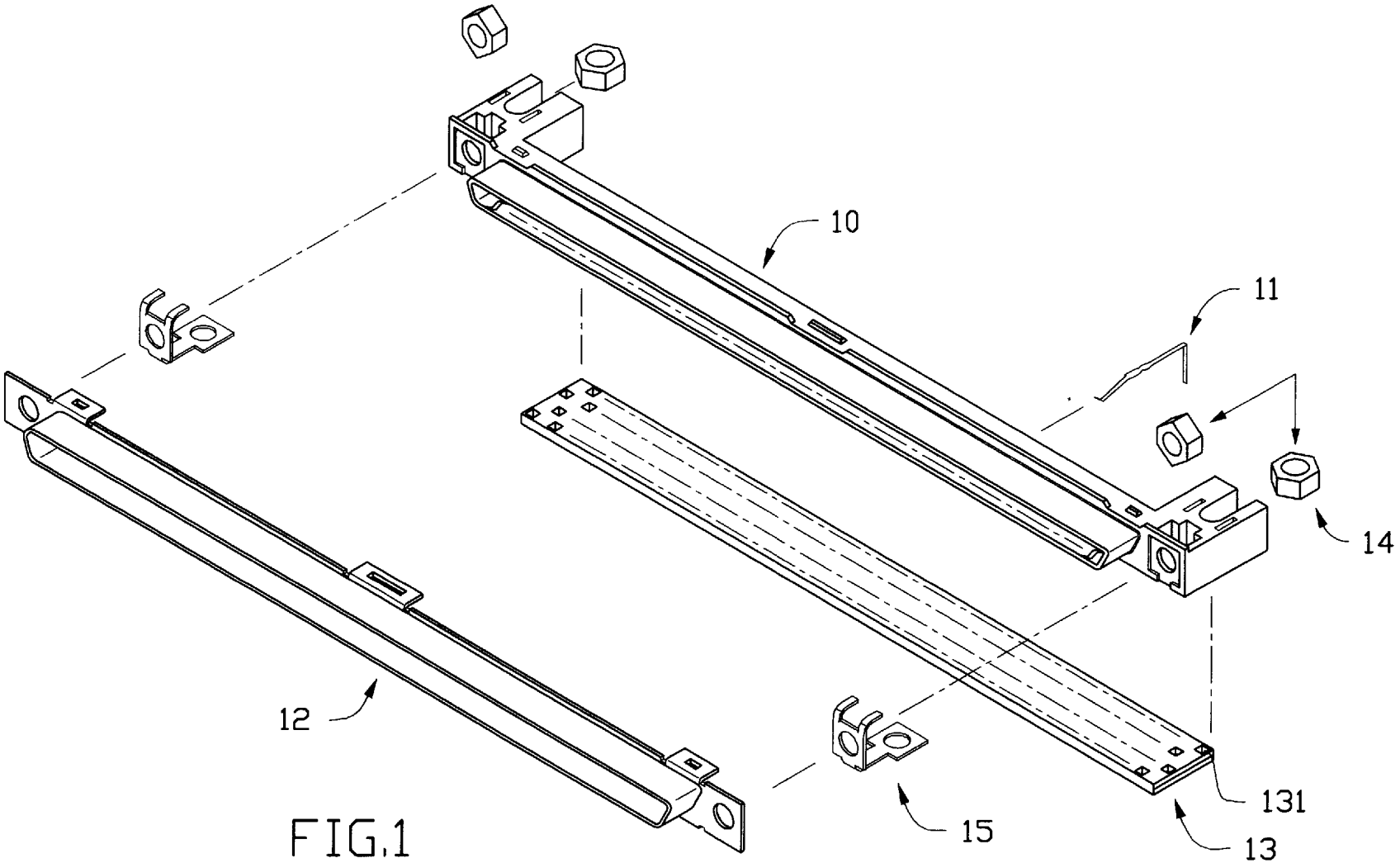
FIG.1 (PRIOR ART)
FIG. 1 is an exploded view of a conventional electrical connector.
Figure 2:
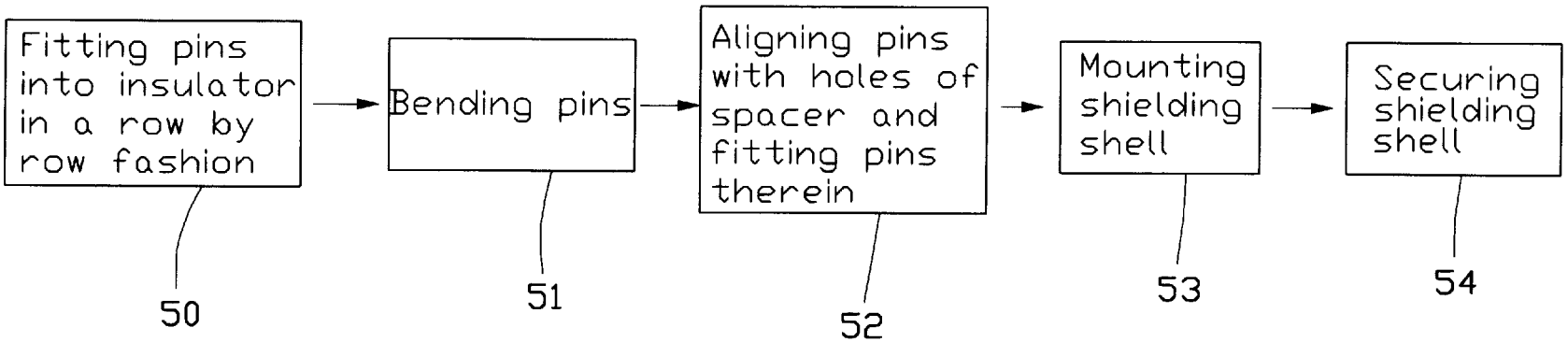
FIG.2 (PRIOR ART)
FIG. 2 is a flow chart describing a conventional method for manufacturing the electrical connector of FIG. 1.
Figure 3:
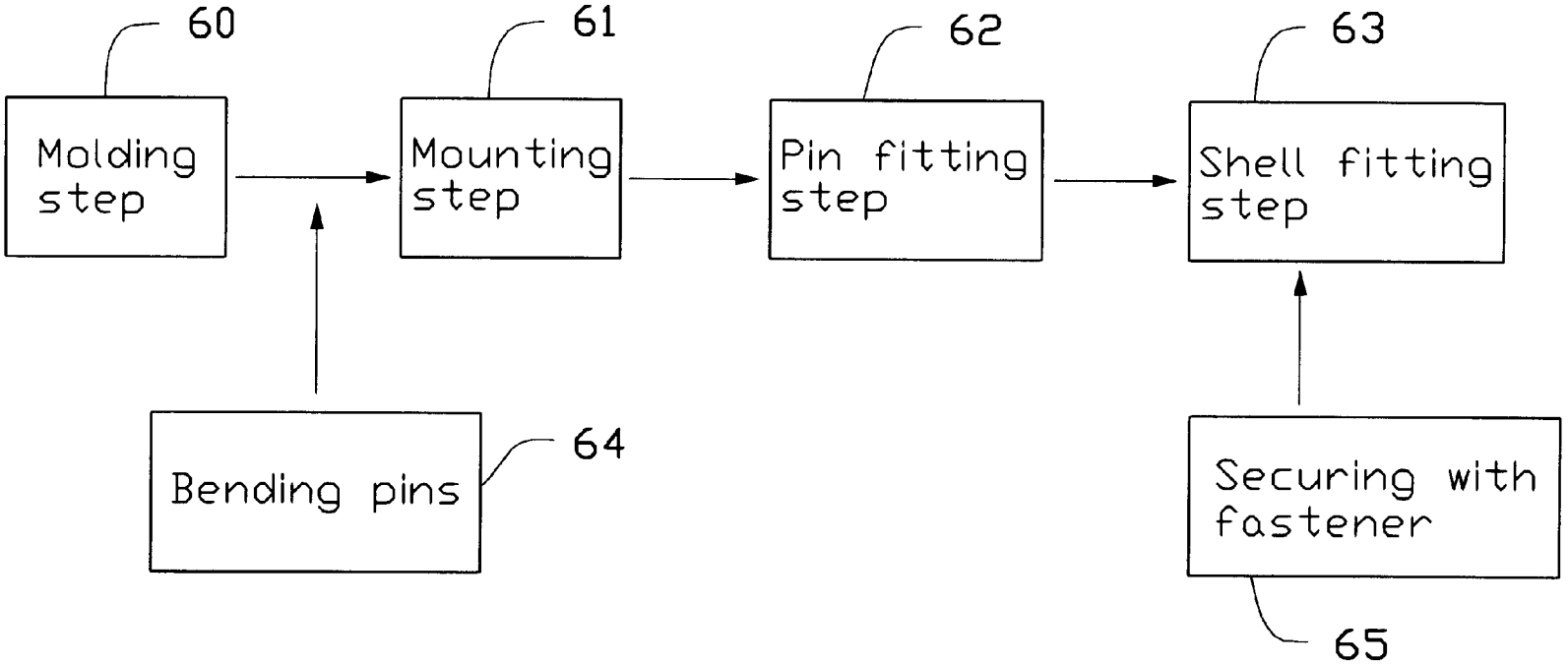
FIG. 3 is a flow chart describing a method for manufacturing an electrical connector in accordance with the present invention.

Referring particularly to FIG. 3, the connector manufacturing process of the present invention comprises the following steps: molding step 60, mounting step 61, pin fitting step 62 and shell fitting step 63. In the molding step 60, the conductive pins 28 are arranged in molds that manufacture the insert plates 21, 22 and are thus integrally formed therewith to form two unitary components. The mounting sections 282 of the pins 28 are then bent at a 90 degree angle (step 64). Thereafter, the mounting step 61 is carried out by inserting the bent mounting sections 282 of the pins 28 into corresponding holes 231 of the spacer 23 component (the unitary component) by component. The insert plates 21, 22 together with the spacer 23 fixed thereto are then inserted into the slot 203 of the insulator 20 (step 62). The shielding shell 24 is positioned around the raised section of the first side face 201 of the insulator 20 (step 63). Finally, the securing means 25 secures the shielding shell 24 to the insulator 20 (step 65).

One feature of the invention is to provide the first insert plate 21 with the first group of pins and a second insert plate 22 with the second group of pins which may respectively and successively mounting to the spacer 23 as a sub-assembly wherein the first insert plate 21 and the second insert plate 22 can be combined with each other. Then this sub-assembly may be mounted to the insulator 20 wherein the first insert plate 21, the second insert plate 22 and the spacer 23 have their own means to respectively latchably engage with different portions of the insulator 20 for being ready for being the final complete connector. Additionally, the grounding plate 26 retainably sandwiched between the first insert plate 21 and the second insert plate 22 may shield electromagnetic interference between the first group of pins and the second group of pins 28.

Although the present invention has been described with respect to a preferred embodiment, it is obvious that equivalent alterations and modifications will occur to those skilled in the art upon reading and understanding the above detailed description. The present invention includes all such equivalent alterations and modifications and is limited only by the scope of the appended claims.

What is claimed is:

1. A method for manufacturing an electrical connector comprising an insulator defining a slot into which insert plates having conductive pins integrally fixed thereon are received, each of the conductive pins having a mounting section received in a positioning hole defined in a spacer, the method comprising the steps of:

(a) molding the insert plates with the conductive pins integrally formed in the insert plates for dividing the pins into groups which form a unitary component with each of the insert plates;

(b) mounting the mounting sections of the pins of each of the unitary components into the corresponding positioning holes of the spacer component by component thereby forming a first sub-assembly;

(c) fitting the insert plates of the first sub-assembly into the slot of the insulator to define a second sub-assembly; and (d) attaching a shielding shell to the insulator.

2. The method as claimed in claim 1 further comprising a bending step after step (a) in which the mounting sections of the pins are bent an angle.

3. The method as claimed in claim 1 further comprising a step of securing the shielding shell to the insulator by means of fastener means.

4. The method as claimed in claim 1, wherein each of the insert plates has two rows of the conductive pins integrally formed therewith.

5. A connector comprising:

an insulator defining a first side face, an opposite second side face and a slot between the first and second side faces, a projection being formed on an inner surface of the slot proximate the first side face;

an insert plate adapted to be received within said slot and forming a notch therein corresponding to the projection of the insulator;

a plurality of pins provided on said insert plate, each pin forming an engaging section for location in the slot of the insulator and a mounting section;

a spacer defining a plurality of positioning holes therein to retain the mounting sections of corresponding pins therein; whereby said insert plate integral with the pins and the spacer are simultaneously installed and retained in the insulator.

6. The connector as claimed in claim 5, wherein a positioning recess is defined in an inner surface of the slot proximate the second side face of the insulator and a positioning projection is formed on the insert plate corresponding to the positioning recess of the insulator for securing the insert plate and the insulator.

7. The connector as claimed in claim 5, wherein the spacer forms at least one barb corresponding to at least one shoulder formed on the insulator for securing the spacer to the insulator.

8. The connector as claimed in claim 5, wherein another insert plate integral with a plurality of pins is mounted to the spacer and assembled to said insert plate to form a sub-assembly before installation to the insulator.

9. The connector as claimed in claim 8, wherein the other insert plate forms a notch therein for engaging with a projection formed on the insulator and a positioning projection thereon for engaging with a positioning recess defined in an inner surface of the slot of the insulator.

10. A connector including:

an insulator defining a slot therein;

a first insert plate with a first group of pins thereof and a second insert plate with a second group of pins thereof being combined together with a grounding plate sandwiched therebetween to form a sub-assembly; and a shielding shell being fixed to a front side of the insulator, said shell defining a D-shaped bracket shielding front portions of the first and second insert plates where the pins are exposed; wherein said sub-assembly is installed into the insulator and retained thereto by means formed on the insulator and at least one of said first and second insert plate, and the grounding plate terminates on the front side of the insulator without entering a space defined in said D-shaped bracket.

11. The connector as claimed in claim 10, wherein a spacer is assembled with the first and second insert plates before said sub-assembly is installed into the insulator.

12. A method for making a connector, comprising steps of:

providing an insulator, a spacer and an insert plate integral with a plurality of pins thereof;

assembling the spacer to the insert plate for forming a sub-assembly by means of engagement of the pins with corresponding positioning holes defined in the spacer; and installing said sub-assembly to the insulator by means formed on the insert plate and the spacer for securing the sub-assembly with the insulator.

13. A sub-assembly for use with a connector, comprising:

a first insert plate integral with a first group of pins thereon;

a second insert plate integral with a second group of pins thereon;

means of combining said first insert plate and said second plate together, said means including a plurality of positioning holes defined in the first insert plate and a plurality of bosses provided on the second insert plate corresponding to the positioning holes of the first insert plate; and a spacer defining a plurality of holes for retaining the pins; wherein said first insert plate and said second insert plate are respectively assembled to the spacer in order.

14. The sub-assembly as claimed in claim 13, wherein a grounding plate is retainably sandwiched between the first insert plate and said second insert plate.

15. The subassembly as claimed in claim 14, wherein the grounding plate defines a plurality of through holes for insertion of the bosses of the second insert plate.

* * * * *